United States Patent [19]

Knapp

[11] 4,099,079

[45] Jul. 4, 1978

[54] SECONDARY-EMISSIVE LAYERS

[75] Inventor: Alan George Knapp, Crawley, England

[73] Assignee: U.S. Philips Corporation, New York, N.Y.

[21] Appl. No.: 639,929

[22] Filed: Dec. 11, 1975

[30] Foreign Application Priority Data

Oct. 30, 1975 [GB] United Kingdom ..... 54006/75

[51] Int. Cl.[2] ..... H01J 43/00

[52] U.S. Cl. ..... 313/103 CM; 313/95; 313/346 R; 252/501; 313/399

[58] Field of Search ..... 313/94, 103, 104, 105, 313/346, 95, 399, 397, 377; 252/181.4, 181.6, 181.7, 501, 500

[56] References Cited

U.S. PATENT DOCUMENTS

| | | | |
|---|---|---|---|
| 1,873,730 | 8/1932 | Wiegand | 252/181.7 |
| 2,003,344 | 6/1935 | de Boer et al. | 252/181.4 |
| 2,254,073 | 8/1941 | Klatzow | 252/181.6 |
| 2,390,701 | 12/1945 | Ferris | 313/104 X |
| 2,620,287 | 12/1952 | Bramley | 313/103 X |
| 2,887,597 | 5/1959 | Smith et al. | 313/103 X |
| 3,182,221 | 5/1965 | Poor, Jr. | 313/103 |
| 3,244,922 | 4/1966 | Wolfgang | 313/103 X |
| 3,468,807 | 9/1969 | Spangenberg | 252/181.4 |
| 3,578,834 | 5/1971 | Porta et al. | 252/181.6 |
| 3,634,712 | 1/1972 | Orthuber | 313/103 |
| 3,724,066 | 4/1973 | Wainer et al. | 313/103 |

*Primary Examiner*—Saxfield Chatmon, Jr.
*Attorney, Agent, or Firm*—Frank R. Trifari; Jack E. Haken

[57] ABSTRACT

A substrate bearing a secondary-emissive layer which consists of a cermet consisting of a readily evaporable metal, for example Au, Ag, Cu, Ni, Cr, Al or a nickel-chromium alloy, and an alkali metal aluminium fluoride, for example cryolite. The substrate material may be, for example mild steel, or a synthetic plastics material. It is possible to make large dynodes when using mild steel substrates which are much cheaper than silver-magnesium or beryllium-copper and the secondary-emissive layer does not require an activation treatment when incorporated in an electric discharge tube.

10 Claims, 5 Drawing Figures

SECONDARY-EMISSIVE LAYERS

Figure 1:
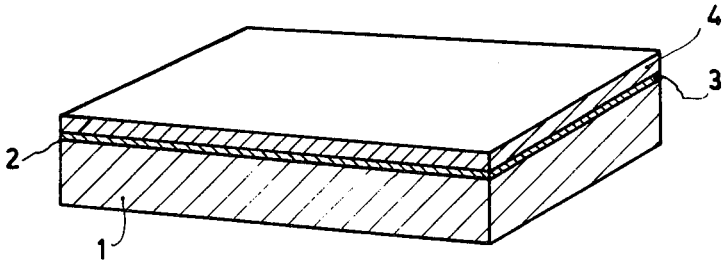

The invention relates to an electrode consisting of at least a substrate bearing a secondary-emissive layer which is composed of several materials, for example, a dynode in an electron multiplier tube or a channel plate.

The invention relates moreover to a method of manufacturing such a secondary-emissive layer on a substrate.

Such an electrode is known from British patent specification No. 1,214,755 in which a sintered mass consisting of cryolite ($Na_3AlF_6$ or sodium aluminium fluoride) and a metal oxide (for example MgO, $Al_2O_3$ or CaO) is provided in a vapor deposition device so as to form therefrom secondary-emissive layers on a substrate by vapor deposition. However, said layers are ceramic layers and insulators so that in electrodes (dynodes) manufactured from this material charging phenomena occur.

It is the object of the invention to avoid this drawback entirely.

According to the invention, an electrode of the kind mentioned in the first paragraph is characterized in that the secondary-emissive layer consists of a cermet comprising a readily evaporable metal and an alkali aluminium fluoride.

The cermet may contain in addition magnesium fluoride, preferably less than 18% by weight of the overall quantity of fluoride. If as a matter of fact less than approximately 18% by weight of magnesium fluoride is present, a homogeneous crystal with the alkali aluminium fluoride is still formed. However, this is not required to obtain a good secondary emission.

The dynodes of a discrete dynode channel plate and of an electron multiplier are also made frequently of beryllium-copper (BeCu) or of silver magnesium (AgMg), which materials can be activated so that a surface having a high secondary-emission factor ($\delta$ = 4–6) is obtained. However, these materials are expensive and beryllium-copper has the addition drawback of being very poisonous so that many precautions in processing said material have to be taken. Mild steel is not considered as a secondary emitter because it has too low a secondary-emission factor ($\delta$ approx. 2).

According to the invention the readily evaporable metal preferably is a metal from the group gold, silver, copper, nickel, chromium or a nickel-chromium alloy.

According to the invention the substrate may be manufactured from an electrically conductive material, for example mild steel, or an insulator, for example a synthetic plastics material (for example the material known by the trade name "Kapton", manufactured by Dupont de Nemours and Co).

A method of manufacturing such a secondary-emissive layer on a substrate comprises the step of evaporating a thin film of the readily evaporable metal on the substrate. Said metal deposition is then continued but an alkali aluminium fluoride is simultaneously vapor-deposited. The vapor deposition of the metal and the alkali aluminium fluoride is discontinued substantially simultaneously.

It has been found that the secondary-emissive layers according to the invention have stable secondary-emission properties if the substrates comprising said layers are stored in dry air. (This may be done, for example, in a dessicator with silica gel.) It has also been found that the value of $\delta$ (secondary-emission factor) does substantially not decrease after the layers had been exposed to the ambient atmosphere for 30 to 60 minutes. Moreover, the assembly process of the dynodes and the electron discharge tubes in which the dynodes are mounted has proved to have no detrimental influence on the quality of said electron discharge tubes.

Dependent on their application, secondary-emissive layers must have a different electric conductivity. In application with electrically conductive dynodes having secondary-emissive layers, the layers need be capable of transporting only so much charge from the metal substrate to the emissive surface that the charge which is dissipated from said surface by secondary emission is replenished. Examples of such applications are electron multipliers of the so-called 37 Venetian-blind" type for the detection of individual particles and channel plates of the laminated type which can be used for imaging and display purposes.

Figure 2:
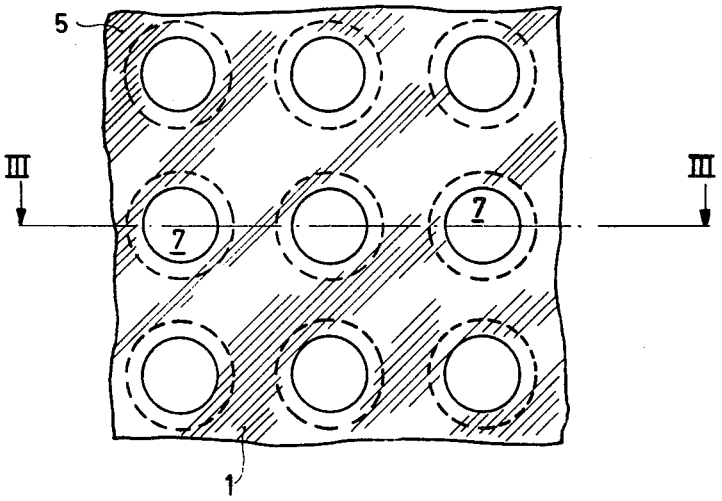
Figure 3:
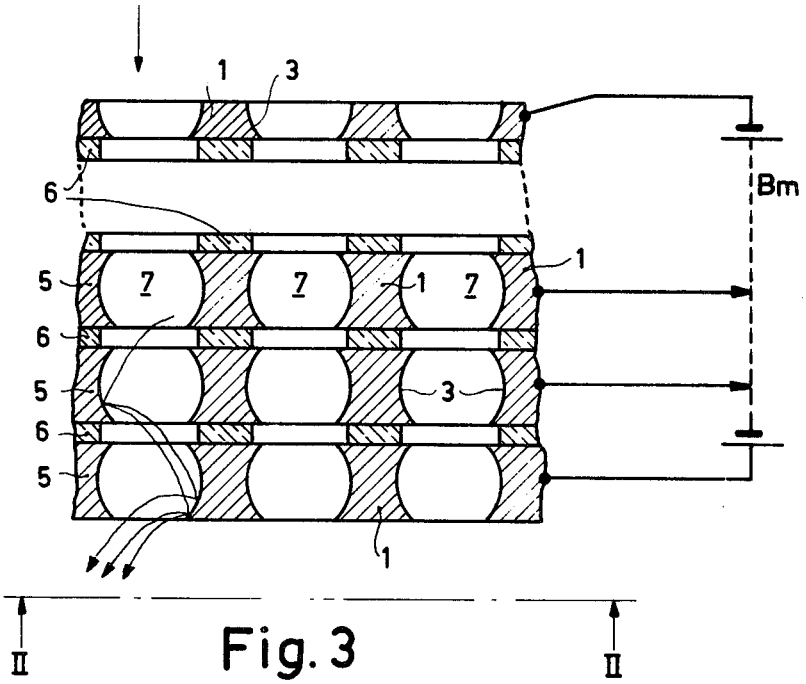
Figure 4:
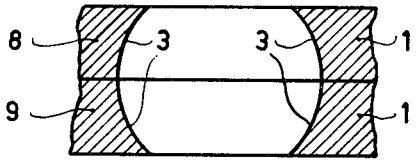
Figure 5:
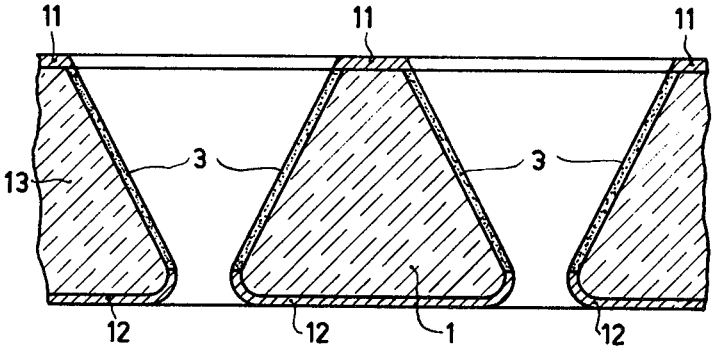

The invention will now be described in greater detail with reference to a figure, in which FIG. 1 is a diagrammatic representation of a part of an electrode, FIGS. 2 and 3 show a channel plate of the laminated type, FIG. 4 shows a dynode made of two halves, and FIG. 5 shows a channel plate having a continuous dynode.

FIG. 1 shows diagrammatically a part of an electrode. The mild steel substrate 1 is covered with a 1–2 μm thick nickel layer 2. Provided on the nickel layer 2 is a nickel chromium layer 3 (200–300 A thick) which serves as a basis for the cermet layer 4 (200 A thick). Said cermet consists of nickel-chromium and cryolite.

FIGS. 2 and 3 show a channel plate of the laminated type in a plan view (FIG. 3) and in a perpendicular cross-sectional view (FIG. 3). This laminated type differs from the usual channel plate in that this channel plate has a construction consisting of plates 5 and 6 having holes 7 provided in a matrix form. It is composed of alternately conductive plates 5 and spacing plates 6 so that the inner wall of each channel is formed by the inner walls of a number of holes of alternatively conductive and spacing material situated one behind the other. As a result of this the inner wall consists of a number of discrete dynodes. The holes of the successive dynodes should be sufficiently aligned to form uninterrupted channels through the channel plate structure. The inner wall of the holes in the conductive plates 5 are covered with the cermet 3 according to the invention. During operation, all successive conductive plates (dynodes) are fed with increasing potentials by a divided direct current source which is denoted diagrammatically by $B_m$. In one channel the direction of the electron amplification in the channel is denoted by arrows.

The cross-sectional view of FIG. 4 shows a dynode having indented aperture as described in British Patent Application No. 16541/73, (Netherlands Patent Application No. 7,404,439 laid open to public inspection), in which the dynode is made from two matching halves 8 and 9. The inner wall is again covered with the cermet 3.

The invention may also be used in photomultipliers having continuous dynodes, for example, the channel plate described in British Patent Application No. 2842/73 (Netherlands Patent Application No. 7,400,765 laid open to public inspection), and shown in FIG. 5. In such a channel plate, each channel is open and may have a very open concial or pyramidal shape. For devices having continuous dynodes the degree of conductivity which is required for the secondary-emissive layers 3 in the channels is based on considerations which differ from those which determine the design of the above-mentioned laminated channel plates. In particular, the layer on each channel wall of the open channel will have to be capable of passing current from an input electrode 11 on the input side of the plate to an output electrode 12 on the output side so as to obtain in this manner a potential gradient along the walls of the channels. In addition it will have to be possible to also replenish the charge lost as a result of secondary emission. Moreover, in contrast with the above-described specimens, the secondary-emissive layers which are electrically conductive are provided on a substrate 13 of insulation material (for example glass or plastics) instead of on a substrate of a conductive material.

The invention will now be further described with reference to two examples.

EXAMPLE 1

A mild steel substrate for a dynode was degreased and was then covered with a 1 to 2 μm thick nickel layer. The mild steel may in addition be decarburised by heating at 900° C in a mixture of 90% nitrogen and 10% hydrogen which has been made moist by passing it through water at room temperature.

The mild steel substrate was then placed in a vacuum deposition device and the pressure was reduced to between $3\times10^{-6}$ and $2\times10^{-5}$ Torr. The substrate was then heated to 300° C and maintained at this temperature. The vacuum deposition of a chromium-nickel alloy consisting of 80% by weight of nickel and 20% by weight of chromium was started 10 minutes after the substrate had reached said temperature. After the deposition of 200 to 300 A of the nickel-chromium alloy, the evaporation of the cryolite was started. In the collective vapor deposition of the nickel-chromium alloy and the cryolite the quantity by weight of deposited cryolite was twice as large as the quantity by weight of the nickel-chromium alloy. The vapor deposition of the nickel-chromium alloy and the cryolite was discontinued simultaneously when the overall thickness of the deposited cermet layer was approximately 2000 A. The extra nickel-chromium alloy layer serves as an extra barrier layer between the material of the cermet and the mild steel so that the decrease of the secondary-emissive properties of the cermet material during its life is restricted.

The secondary-emission coefficient δ of the above-described nickel-chromium alloy-cryolite cermet decreased initially upon irradiating with electrons having an energy of 300 eV but recovered to a constant value of 3–4 subsequently. Dependent on the way of activating, the δ for a beryllium-copper surface would in the same circumstances be 4 to 5 and for a silver-magnesium surface which was irradiated with 200 eV electrons it would be more than 5.

EXAMPLE 2

Equal weights of cryolite and magnesium fluoride were mixed and placed in an evaporation boat. The boat was then heated so as to melt this mixture and the contents of the boat were allowed to solidify.

A mild steel dynode substrate which had been degreased was nickel-plated with 2 μm of nickel. The nickel-plated mild steel substrate was then placed in a vacuum evaporation apparatus, and the pressure was reduced to between $3\times10^{-6}$ and $2\times10^{-5}$ Torr. The substrate was then heated to 300° C and was maintained at this temperature. Vacuum evaporation of gold was commerced 10 minutes after the substrate had reached this temperature. After 200–300 A of gold had been deposited, evaporation of the mixture of cryolite and magnesium fluoride was commenced, the rate of deposition of the cryolite plus magnesium fluoride being four times the rate of deposition (in terms of mass) of the gold. When the total thickness of the deposited film had reached 2000 A, evaporation of the gold and of the cryolite plus magnesium fluoride was stopped simultaneously.

When the resulting cermet film was irradiated with 300 eV electrons, the δ of the layer was initially 4.1, but after 4 minutes δ had fallen to 2.25.The electron beam used to irradiate the cermet had a current density of 25 μA/sq. cm. on the cermet surface. After 40 minutes of irradiation, δ had recovered to a value of 2 and after 1300 minutes it was found that δ had reached a steady value of 4.9. The pattern of the change in values of δ for the nickel-chromium cryolite cermet prepared by the method described in Example 1 was similar to the pattern observed with this gold-cryolite-magnesium fluoride cermet.

Although the suitability of the cermet according to the invention has been mainly described with reference to examples relating to dynodes of channel plates, it will be obvious to those skilled in the art that such a cermet can successfully be used in all electrodes which have to be provided with a secondary-emissive layer. Hence the invention is by no means restricted to channel plates.

What is claimed is:

1. An electrode having a secondary-emissive layer, said layer consisting essentially of a cermet comprising a readily-evaporable metal and an alkali aluminum fluoride.

2. An electrode as defined in claim 1 wherein said alkali aluminum fluoride is sodium aluminum fluoride.

3. An electrode as defined in claim 2 wherein said cermet also comprises magnesium fluoride.

4. An electrode as defined in claim 3 wherein said magnesium fluoride is by weight leass than 18 percent of the total quantity of sodium aluminum fluoride and magnesium fluoride.

5. An electrode as defined in claim 1 wherein the readily-evaporable metal is a metal selected from the group consisting of gold, silver, copper, nickel, chromium and nickel-chromium alloys.

6. An electrode as defined in claim 5 wherein said alkali aluminium fluoride is sodium aluminum fluoride.

7. An electrode as defined in claim 1 wherein the cermet is by weight between 10 and 60 percent readily-evaporable metal.

8. An electrode as defined in claim 1 further comprising a substrate of mild steel and a layer of nickel or nickel-chromium alloy between said substrate and said secondary-emissive layer.

9. An electrode as defined in claim 1 further comprising a substrate of synthetic plastic material.

10. A method of manufacturing an electrode as claimed in claim 1, characterized in that a thin film of readily-evaporable metal is deposited on the substrate and that the readily-evaporable metal is then deposited together with an alkali aluminium fluoride, after which the deposition of metal and the fluoride is discontinued simultaneously.

* * * * *